US009375057B2

(12) United States Patent
Oakley et al.

(10) Patent No.: US 9,375,057 B2
(45) Date of Patent: Jun. 28, 2016

(54) SNAP BUTTON AND METHOD OF USE

(71) Applicants: Annalee Oakley, Chicago, IL (US); Gloria Alicia Schwartz, Chicago, IL (US)

(72) Inventors: Annalee Oakley, Chicago, IL (US); Gloria Alicia Schwartz, Chicago, IL (US)

( * ) Notice: Subject to any disclaimer, the term of this patent is extended or adjusted under 35 U.S.C. 154(b) by 49 days.

(21) Appl. No.: 14/120,435

(22) Filed: Mar. 14, 2014

(65) Prior Publication Data

US 2015/0257494 A1 Sep. 17, 2015

(51) Int. Cl.

| | |
|---|---|
| ***A44B 17/00*** | (2006.01) |
| ***A63F 9/10*** | (2006.01) |
| ***A44C 3/00*** | (2006.01) |

(52) U.S. Cl.

CPC ..... *A44B 17/0082* (2013.01); *A44B 17/0011* (2013.01); *A44B 17/0023* (2013.01); *A44B 17/0047* (2013.01); *A44C 3/001* (2013.01); *A63F 9/10* (2013.01); *A63F 2009/1022* (2013.01); *Y10T 24/45047* (2015.01)

(58) Field of Classification Search

CPC . A63F 9/10; A63F 9/0073; A63F 2009/1022; A44B 17/0088; A44B 17/0011; Y10T 24/367; Y10T 24/3672; Y10T 24/3694; Y10T 24/45838; Y10T 24/366

See application file for complete search history.

(56) References Cited

U.S. PATENT DOCUMENTS 477,857 A * 6/1892 Goodwin ..... A44B 17/0082 24/692
488,219 A 12/1892 Platt
494,104 A * 3/1893 Kraetzer ..... A44B 17/0082 24/692
1,360,914 A * 11/1920 Forslund ..... A44B 17/0082 24/691
1,410,916 A 3/1922 Hendrix
1,729,778 A * 10/1929 Hoag ..... G09F 3/12 40/1.6
1,732,837 A * 10/1929 Fenton ..... A44B 17/0052 24/681
1,769,685 A * 7/1930 Goddu ..... A44B 17/0052 24/681
1,796,525 A * 3/1931 Johnson ..... A44B 17/0052 16/4
1,872,968 A * 8/1932 Kimbell ..... A44B 17/007 24/691
2,012,241 A * 8/1935 Dill ..... A44B 17/0052 24/681
3,141,211 A 7/1964 Blake
3,534,446 A 10/1970 Silver
4,050,184 A * 9/1977 Chiari ..... A63H 33/101 273/157 R
4,344,240 A 8/1982 Schiller
4,481,696 A 11/1984 Kanzaka
4,607,415 A 8/1986 Fukuroi
4,662,033 A 5/1987 Wieland, Jr. et al.

(Continued)

OTHER PUBLICATIONS http://mockingbird.creighton.edu/english/fajardo/teachingmiscellan/understand.htm; Understanding Literature.

(Continued)

*Primary Examiner* — Steven Wong
(74) *Attorney, Agent, or Firm* — James Ray and Assocs; Alexander Pokot

(57) ABSTRACT

A button assembly includes a back member, a socket or a stud secured with an eyelet or a rivet to the back member and a shell crimped onto the back member. Indicia may be disposed on the exterior surface of the shell. The button assemblies, each with a unique image, can be used to form a puzzle or provide a method of personal expression or a method of communication.

19 Claims, 8 Drawing Sheets

(56) References Cited

U.S. PATENT DOCUMENTS

| | | | | |
|---|---|---|---|---|
| 4,686,749 | A * | 8/1987 | Fukuroi | A44B 17/0088 24/113 R |
| 4,698,881 | A * | 10/1987 | Watanabe | A44B 17/0088 24/113 MP |
| 4,875,257 | A | 10/1989 | Anderson et al. | |
| 4,969,241 | A | 11/1990 | Griffin | |
| 5,014,400 | A | 5/1991 | Ban | |
| 5,093,965 | A | 3/1992 | Mauras et al. | |
| 5,212,851 | A | 5/1993 | Wantanabe | |
| 5,745,964 | A * | 5/1998 | Luer | A44B 17/0088 24/113 MP |
| 5,926,920 | A | 7/1999 | Denison | |
| 6,012,203 | A | 1/2000 | Baron Pearson | |
| 7,698,836 | B2 | 4/2010 | Schmelzer et al. | |
| 8,069,538 | B2 | 12/2011 | Wilcox | |
| 8,122,519 | B2 | 2/2012 | Schmelzer et al. | |
| 8,561,264 | B2 | 10/2013 | Hasegawa et al. | |
| 2006/0021198 | A1 * | 2/2006 | Raccosta | A44B 17/0082 24/104 |
| 2008/0203659 | A1 * | 8/2008 | Cabrera | A63F 3/0415 273/153 R |
| 2009/0113678 | A1 * | 5/2009 | Shimizu | A44B 17/0047 24/662 |
| 2009/0229030 | A1 | 9/2009 | Devisch et al. | |
| 2011/0016679 | A1 * | 1/2011 | Candotti | A44B 17/0011 24/700 |
| 2012/0137409 | A1 * | 6/2012 | Chrysostom | A44C 3/001 2/244 |
| 2012/0199505 | A1 | 8/2012 | Black et al. | |
| 2012/0317760 | A1 | 12/2012 | Kamiya et al. | |

OTHER PUBLICATIONS http://web.mst.edu/-gdoty/classees/concepts-practices/symbolism.html; Signs, Symbols, Meaning, & Interpretation.

http://sell.bizrice.com/selling-leads/1305673/painted-metal-snap-button-oeko-tex-html; Painted Metal Snap Button (OEKO-TEX)/China Buttons for Sale.

* cited by examiner

SNAP BUTTON AND METHOD OF USE

CROSS-REFERENCE TO RELATED APPLICATIONS

N/A

FIELD OF THE INVENTION

The present invention relates, in general, to a decoration of apparel, purses, bags, backpacks, footwear, fashion accessories and the like and, more particularly, this invention relates to snap-on adornment and for a releasable attachment to a socket or a stud member and a method of use thereof.

STATEMENT REGARDING FEDERALLY SPONSORED RESEARCH AND DEVELOPMENT

N/A

REFERENCE TO SEQUENCE LISTING, A TABLE, OR A COMPUTER PROGRAM LISTING COMPACT DISC APPENDIX

N/A

BACKGROUND OF THE INVENTION

As is generally well known, electronic devices and social media have become predominant communication tools. Whether it is texting, e-mailing, sending snap shots, tweeting or posting personal information, the information is transmitted in a digital format. As such, Applicants found that many lack an opportunity and/or means to generate a conversation without use of electronic devices and/or social media, as well as, to express their individual traits, choices, attitudes, behavior, interests and the like.

SUMMARY OF THE INVENTION

The invention provides a button that includes a socket on a back surface thereof for a snap-on engagement onto a complimentary stud that is affixed to a surface.

OBJECTS OF THE INVENTION

It is, therefore, one of the objects of the present invention to provide a snap-on button that allows for a more secure way to fasten a badge/button.

Another object of the present invention is to provide a snap-on button that allows for a quicker removal and interchangeability.

Yet another object of the present invention is to provide a snap-on button that provides a more fun way to wear buttons/badges.

A further object of the present invention is to provide a snap-on button that can be used in any way a standard pin/badge is used, but not limited to those applications, eg, decoration, promotion, campaign, fashion, reward system (think girl scout badges), recognition (think volunteer, nursing staff), souvenir, accessory.

Yet a further object of the present invention is to provide a snap-back button attached to a male part of snap, providing a safe alternative to pin-back buttons.

An additional object of the present invention is to provide a more easily transferable/tradeable/interchangeable way to wear/use buttons/badges.

In addition to the several objects and advantages of the present invention which have been described with some degree of specificity above, various other objects and advantages of the invention will become more readily apparent to those persons who are skilled in the relevant art, particularly, when such description is taken in conjunction with the attached drawing Figures and with the appended claims.

BRIEF DESCRIPTION OF THE VARIOUS EMBODIMENTS OF THE INVENTION

Figure 1:
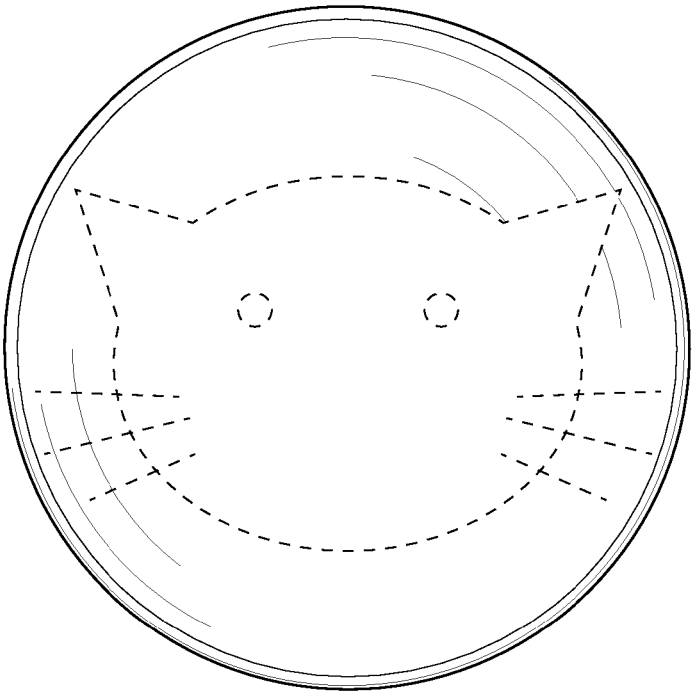
FIG. 1 illustrates a top planar view of a button constructed in accordance with one embodiment of the invention.
Figure 2:
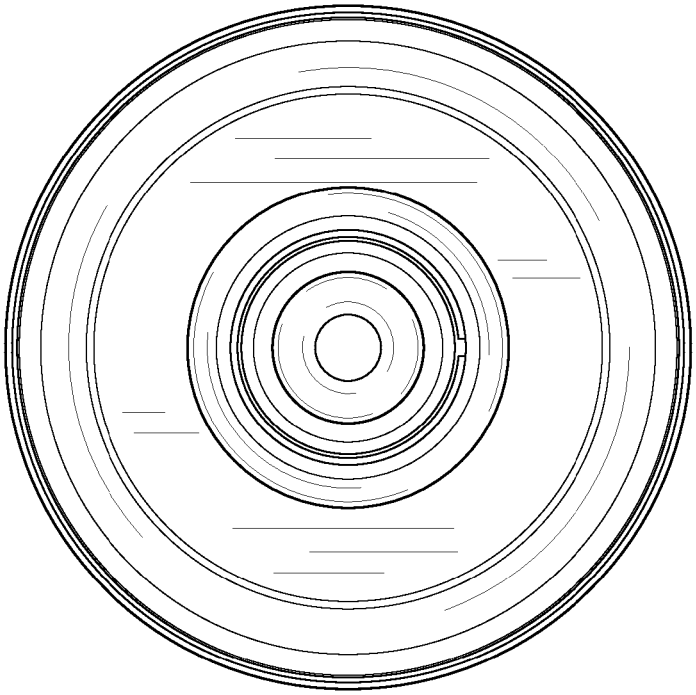
FIG. 2 illustrates a bottom view of the button of FIG. 1.
Figure 3:
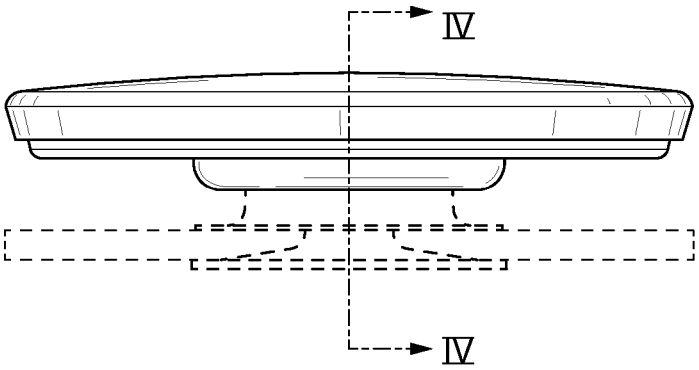
FIG. 3 illustrates a side elevation view of the button of FIG. 1.
Figure 4:
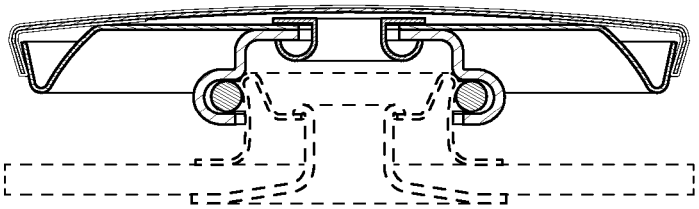
FIG. 4 illustrates a cross-sectional view of the button of FIG. 1 along lines IV-IV of FIG. 3.
Figure 5:
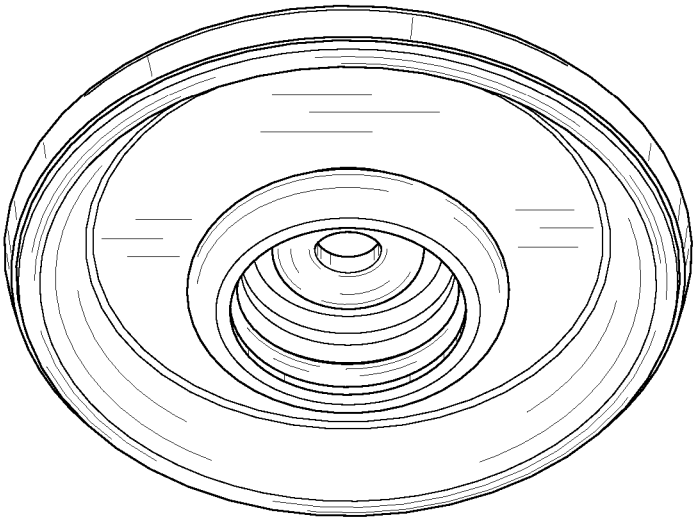
FIG. 5 illustrates a rear 3-dimensional view of the button of FIG. 1.
Figure 6:
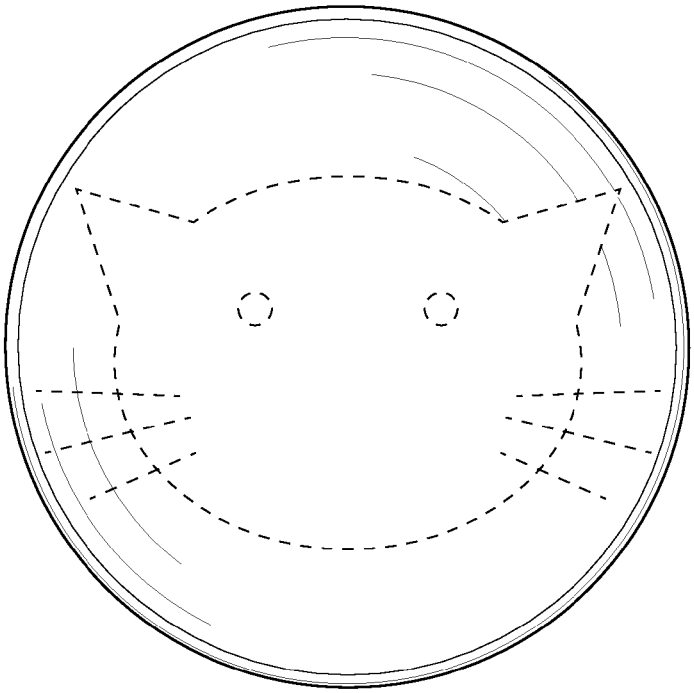
FIG. 6 illustrates a top planar view of a button constructed in accordance with another embodiment of the invention.
Figure 7:
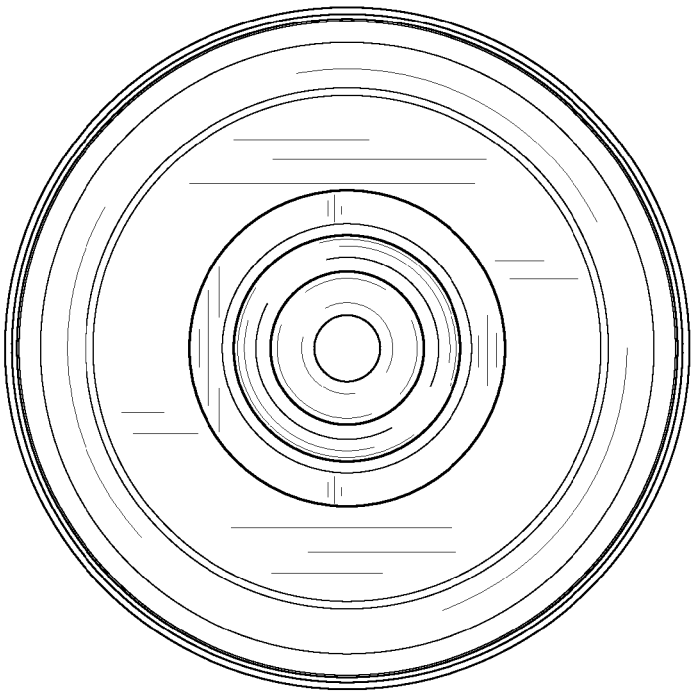
FIG. 7 illustrates a bottom view of the button of FIG. 6.
Figure 8:
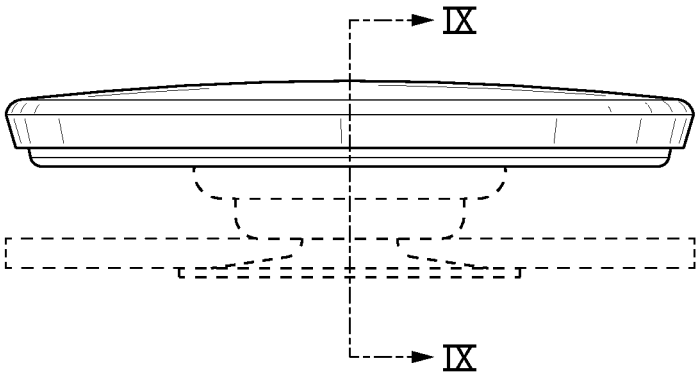
FIG. 8 illustrates a side elevation view of the button of FIG. 6.
Figure 9:
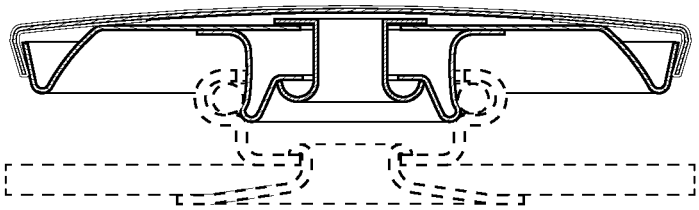
FIG. 9 illustrates a cross-sectional view of the button of FIG. 6 along lines IX-IX of FIG. 8.
Figure 10:
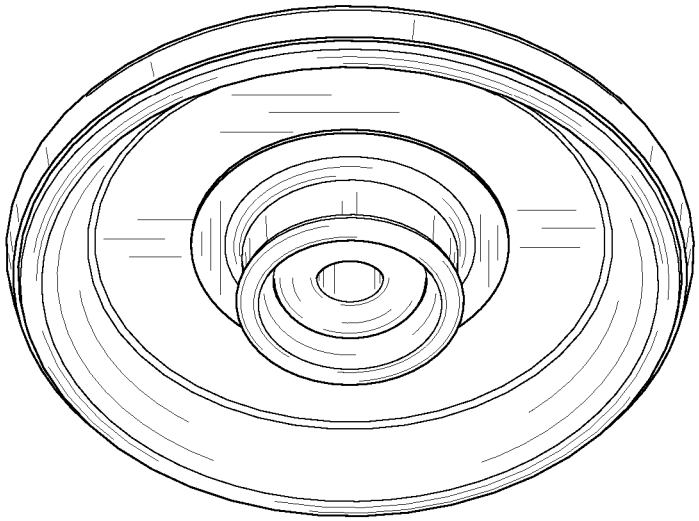
FIG. 10 illustrates a rear 3-dimensional view of the button of FIG. 6.
Figure 11:
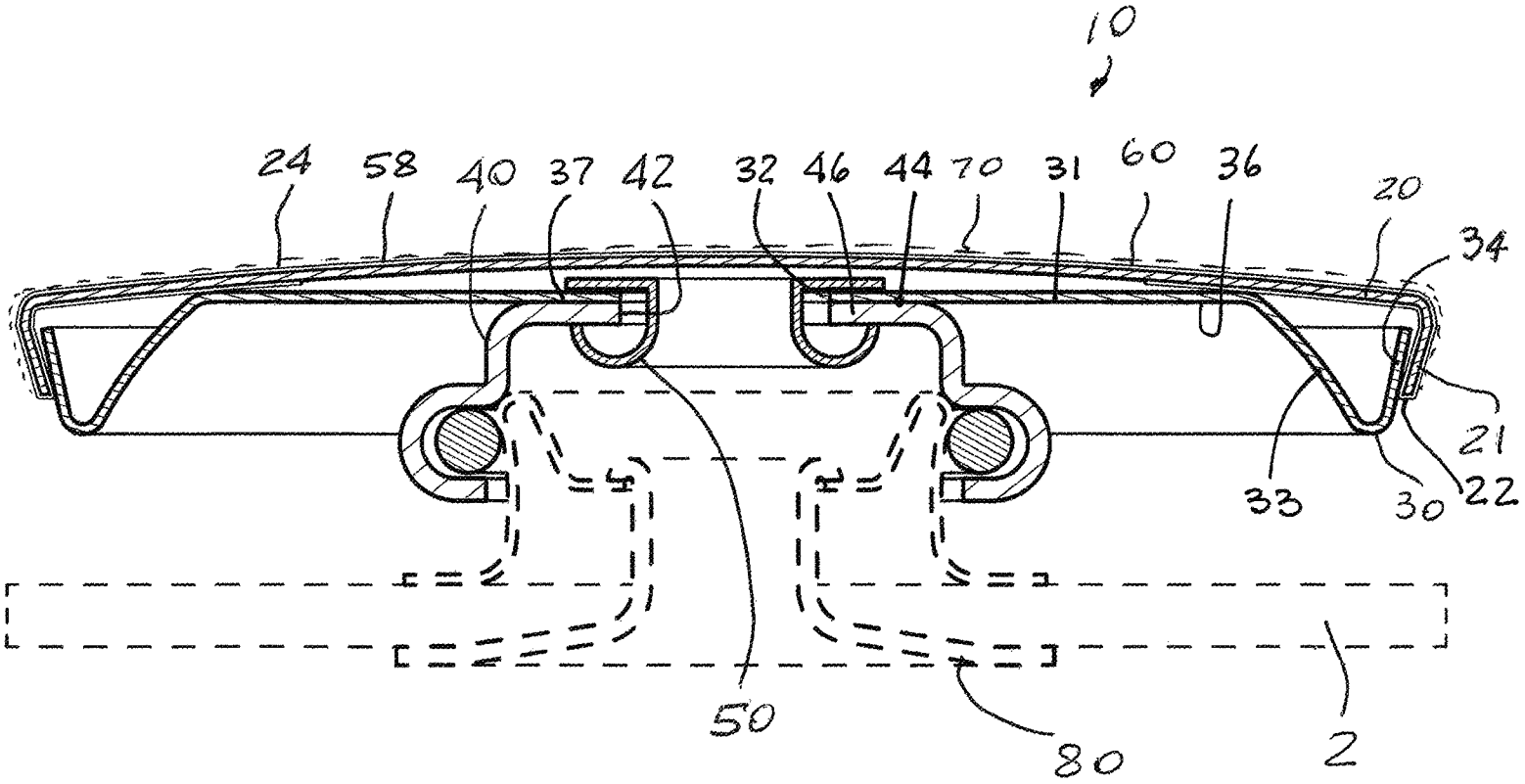
FIG. 11 illustrates an enlarged view of FIG. 4.
Figure 12:
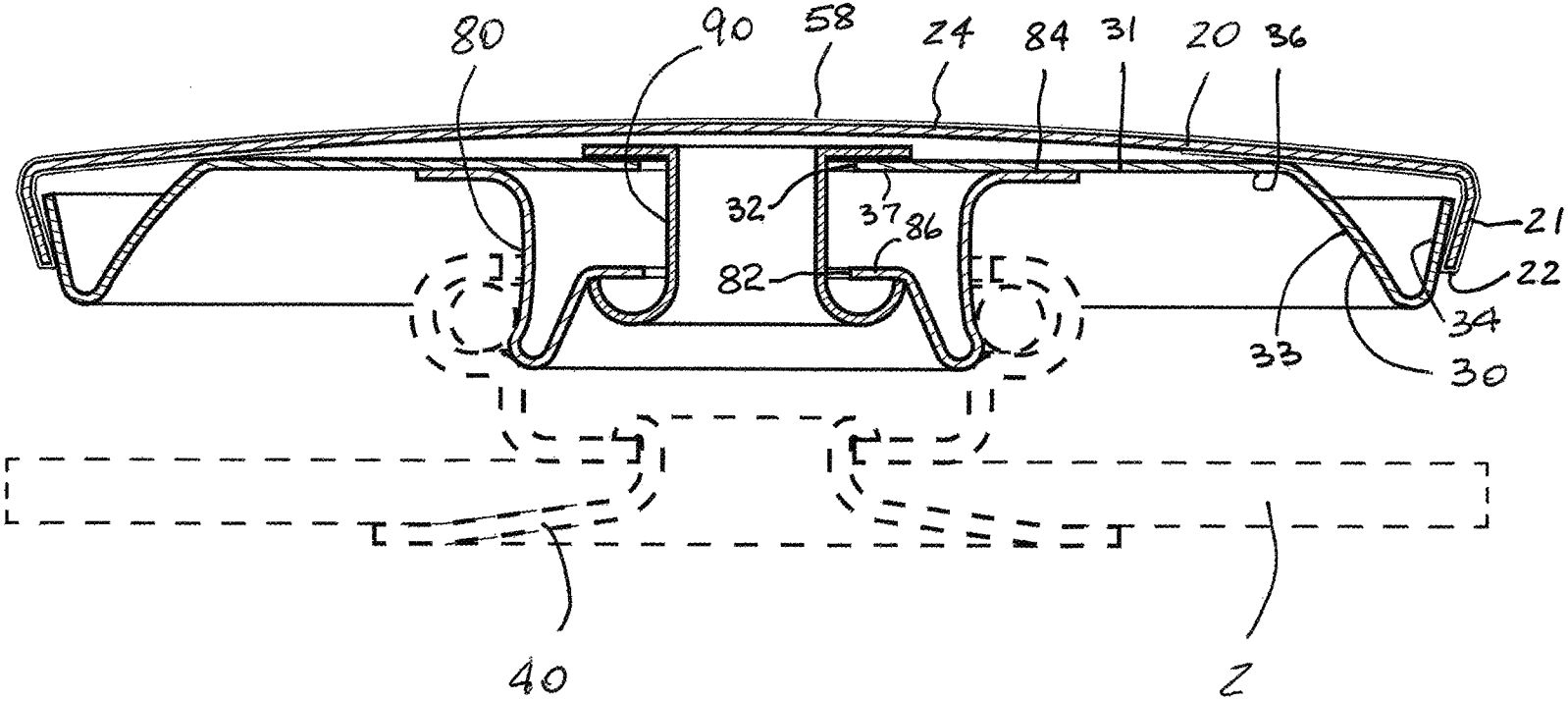
FIG. 12 illustrates an enlarged view of FIG. 9.

Prior to proceeding to the more detailed description of the present invention, it should be noted that, for the sake of clarity and understanding, identical components which have identical functions have been identified with identical reference numerals throughout the several views illustrated in the drawing figures.

Reference is now made, to FIGS. 1-5 and 11, wherein there is shown a button assembly, generally designated as 10. In a particular reference to FIG. 11, the button assembly 10 includes a shell 20 that is illustrated as having a convex, partially spherical shaped with a round peripheral edge 22 that can be outwardly disposed prior to assembly. The button assembly 10 also includes a back member 30 with a central aperture 32 formed through a thickness thereof and a peripheral flange 34 that is tapered outwardly. A socket 40 is also provided and has another central aperture 42. During assembly, apertures 32 and 42 are aligned with each other and the socket 40 is secured to the back member 30 with a rivet or eyelet 50.

The exterior surface 24 of the button 20 may be adapted with indicia 58 either being directly adhered to the surface 24 or the invention may provide an optional member 60 having the indicia 58 thereon and further provided with a clear protective member 70, manufactured for example from a clear Mylar material.

To complete the button assembly 10, the shell 20 with or without members 60 and 70 is crimped around the back portion 30 having the socket 40 attached thereto.

In use, the button assembly 10 is snapped onto the stud member 80, shown in one form for environmental purposes only, which is attached to item 2 that can be, without limitations, any one of apparel, purse, bag, backpack, footwear, fashion accessories, pegboard, shaped object and the like.

FIGS. 6-10 and 12 illustrate a button assembly, generally designated as 10', constructed in accordance with another embodiment of the invention, wherein the socket 40 has been replaced with the stud member 80 attached to the back member 30 with an eyelet or rivet 90.

The button assembly 10' would snap onto the socket 40 attached to such member 2.

Without any limitation, the shell 20 may have any shape, including a shape of particular indicia 58.

Figure 13:
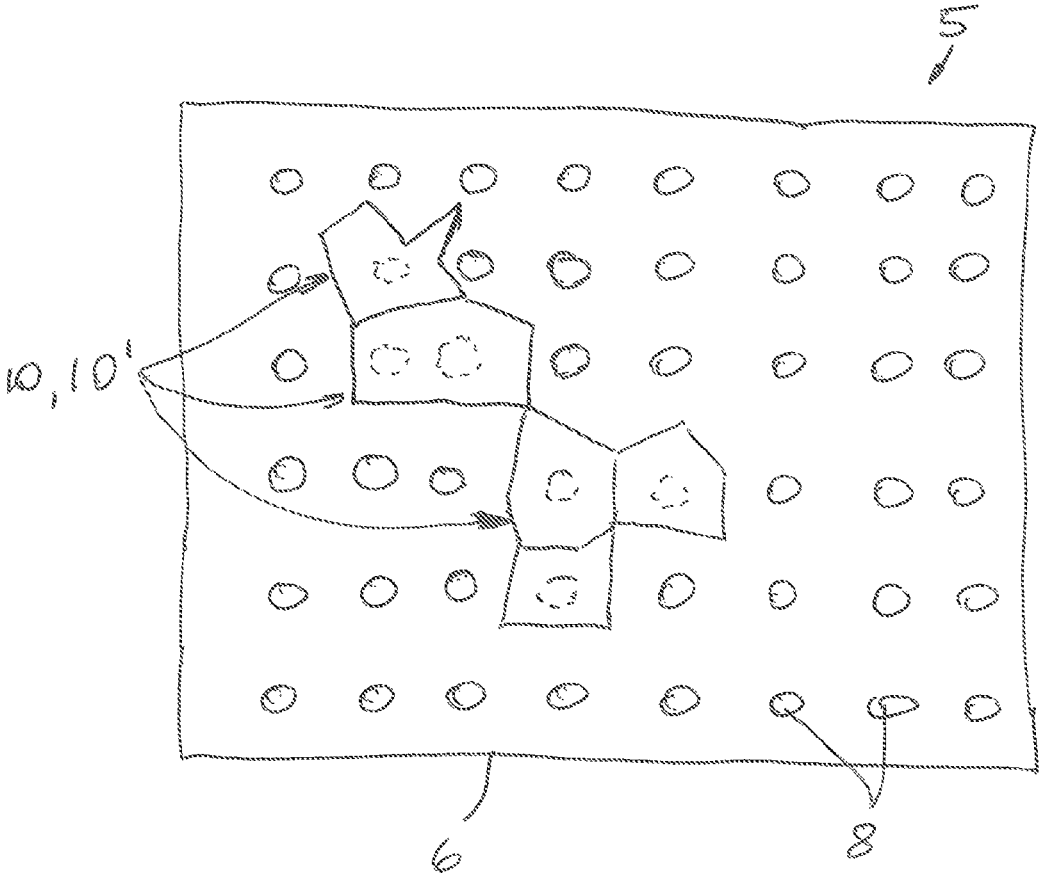
FIG. 13 illustrates an environmental view of the buttons of FIGS. 1-10 employed in a construction of a picture puzzle illustrated in a combination with a peg board substrate material.

In accordance with one embodiment of FIG. 13, the invention provides a novel floor puzzle 5 that includes a plurality of buttons 10, 10' and a substrate 6, which is illustrated as a conventional pegboard having grid of apertures 8 formed through a thickness thereof. The user simply inserts either a socket 40 or the stud 80 into the aperture 8 or the pegboard 6 can be provided with such sockets 40 or studs 80 preinstalled for a more secure retention of the buttons 10, 10'. The indicia 58 would be unique for each specific button 10, 10' so as to allow the user to properly construct the picture puzzle 5. It is contemplated that the socket 40 or stud 80 may be offset from the center of each button 10, 10'. Furthermore, it is contemplated that such pegboard substrate 6 can be of flexible, semi-rigid or rigid construction.

Figure 15:
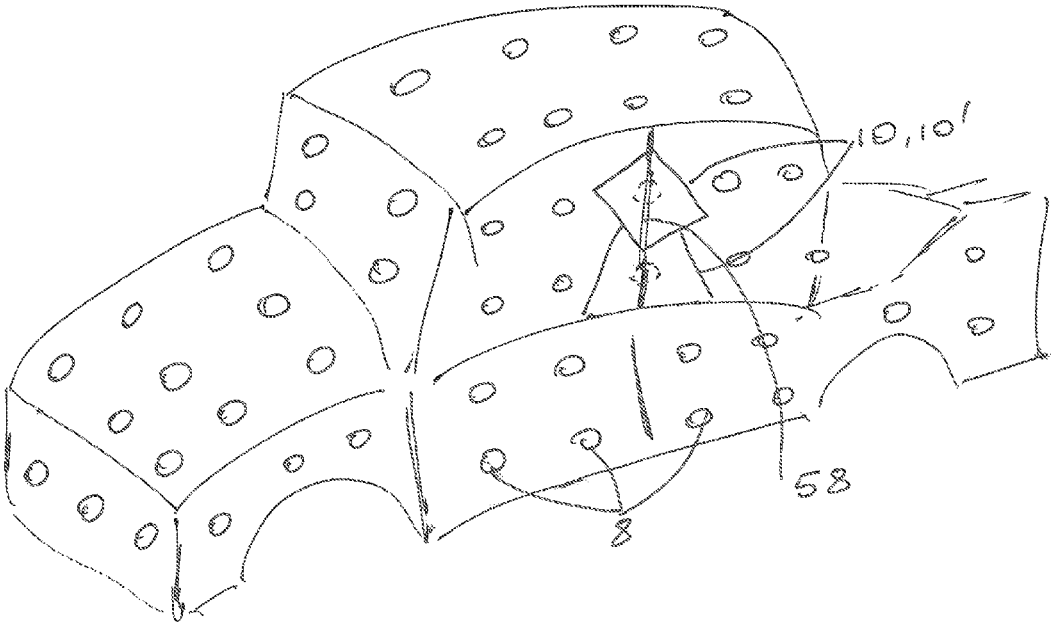
FIG. 15 illustrates an environmental view of the buttons of FIGS. 1-10 attached to a shaped object depicting a conventional automobile.

Now in reference to FIG. 15, the flat pegboard substrate can be replaced by any shaped having either apertures (or cavities) 8 or the sockets 40 or studs 80 disposed on a surface or surfaces thereof so that the user can create any shape or object with the buttons 10, 10'. For example such substrate can be a 3-d outline of a car and the indicia 58 on each button 10, 10' is shown as containing a portion of a door post outline, and could be any one of a portion of a wheel, door, trunk, roof, etc. In other words, the user can build a model by using buttons 10, 10' and repetitively selecting a specific button 10, 10' so as to complete a homogenous representation of such model.

In accordance with another embodiment of the invention, the purpose of using button(s) 10 is to allow the wearer or user of the button(s) is to express his or her individual traits, choices, attitudes, behavior, interests and the like as well as to generate a conversation by way of specific indicia displayed on the surface of the button(s) 10. In today's world where everyone is attached to and/or distracted by an electronic device, buttons 10 are configured to bring people together.

Figure 14:
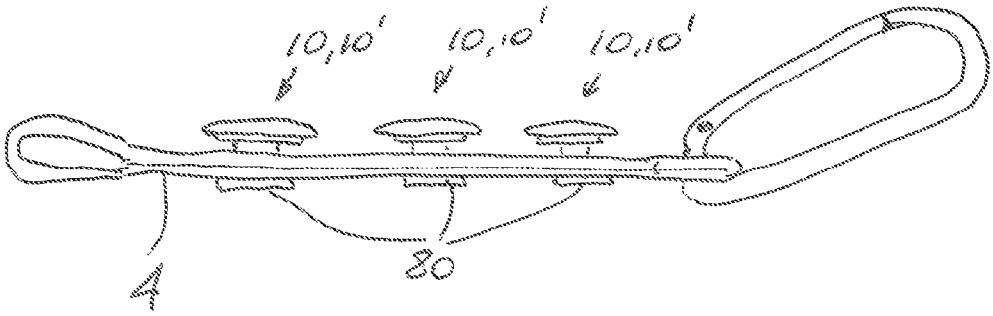
FIG. 14 illustrates an environmental view of the buttons of FIGS. 1-10 attached to a lanyard type substrate material.

Indicia or image on the button 10 is provided such that a plurality of buttons 10 having a different image on a surface thereof tells a story or a tale. By way of one example only, buttons 10 are attached to a strip of nylon webbing, for example such as a lanyard of FIG. 14, and contain images that are related to one theme. The invention contemplates that the user of the buttons 10 will be required to have only a group of preselected number of buttons in order to tell the story. In one exemplary embodiment, such number of buttons 10 is four, but it could be less or more depending on the type of the story. The collection of buttons 10 can be interpreted in various distinct ways. The whole is more than the sum of its parts.

In another form, either a single button 10 or the group of preselected buttons 10 is provided so as to determine/decipher meaning of a particular button 10. In one example, an elephant image may mean that the wearer of such button 10 'likes jungle animals', 'likes to eat' or 'has republican leanings'. In another example, a rubber ducky image may mean that the wearer of such button 10 'likes bubble baths' or is 'a germ-a-phobe'.

The instant invention configures the images on the buttons 10 such that an image's shear ambiguity can often spark a conversation 'hey, what is the meaning of that geometric shape or squiggle?'

The invention also provides a condition wherein a person tries to determine/decipher a combination/collection of snaps, particularly when the images in one combination of buttons 10 are seemingly unrelated to each other.

The invention also provides a system or method, wherein the image on the button or images on a group of buttons correspond with an online content or unlock a specific online content. Online content could include profiles/personalities of the characters and character conversations/stories. The user (collector) of the buttons will be able to group images that fit each character. For example, one character may have a pet, live in the city and eat pizza. Further, these images/characters can be used in books, puzzles, and games. The button/badges with these images would be available individually to be used collectively on tales or placed into a book with a story with periodic blank spaces (studs). Once all studs are filled, the story is complete and ready to read. If the buttons are placed randomly you can have infinite silly stories. The buttons can be placed with grammar rules observed (i.e. noun, adjective, verb) somewhat like Mad Libs, to make the story more coherent. Further, the story can constantly evolve as a person collects more buttons with different images and thus introduces new characters, settings, actions and objects into the story. Games may include treasure hunt/geo-cache type activities.

In other embodiments, the buttons 10 are provided to:

- generate/initiate verbal communication
- are ice-breakers to start a conversation with someone
- allow for individual expression
- allow individuals to tell their personal story, interests, experiences
- are designed to express moods, opinions, interests, feelings
- facilitate the meeting of someone with a common interest
- allow for the user to live in the moment, be happy, make new acquaintances
- allow one to 'wear and share' their story
- are always open for interpretation.
- allow one to change their story/mood simultaneously and instantaneously.

The method of using the buttons 10 and/more particularly, the sign and/or symbol image provided thereby are important concepts to understand in discussing any subjects, for example such as a literature. Even experts define and use them in different ways. A sign is anything that stands for something else. A sign represents something—an idea, an experience, a feeling, an object, etc. Words as ordinarily used are signs in this sense. The object referred to by a sign does not need to be present for the meaning of the sign to be understood. Context helps define the specific meaning of a sign. (Dictionaries list only general meanings). The word tree generally stands for a large class of plants; if I say, "Look at that tree," I am designating a specific meaning for the word. As defined, a sign has a literal meaning; that is, its meaning is simple and straightforward, a matter of conventional agreement among people who use that particular sign. A symbol has complex meaning; it has not only "literal" meaning, but also additional meaning(s) beyond the literal. Sometimes the literal meaning of a symbol is absurd, so that the symbolic meaning overrides and cancels out the literal meaning. A symbol may have more than one meaning. In fact, the most significant symbols do convey an indefinite range of meanings. In the context of Christian symbolism, a tree can refer to the cross on which Jesus was crucified. Thus, in the right context, a tree can suggest a much wider range of meaning than its simple, literal meaning.

Symbols with fairly fixed meanings can be used as ciphers; that is, the symbols can be arranged to encode a meaning that only someone who understands the cipher system can decode. (Symbols used in this way are not really signs because the literal meaning is not intended; the reader is supposed to decipher the symbolic meaning). In using symbols in this manner, the author has a clear "story" (set of ideas) already in mind; the author simply transposes that pre-existing story item by item into a symbolic system, matching each element in the story with an appropriate cipher. The reader then decodes the cipher by transposing back into the original meaning. People often treat literature as a cipher, although that works with only a limited number of literary works. Allegory is closest to cipher, but good allegory is richer in meaning and feeling than limited cipher systems.

The symbol can be defined as being similar to a metaphor. A metaphor is a statement that means something different, or more, than its literal meaning. For instance, Psalm 103.14 says that God "remembers that we are dust." Literally, human beings are not dust; metaphorically, to call us dust is to express the transiency and humility of human life. Psalm 103 continues, using a familiar simile: "As for mortals, their days are like grass" (103.15a). (A simile is like a metaphor, except that it uses the words "like" or "as" to make a more explicit comparison).

A symbol may be also defined as being different than a metaphor in that a symbol is used more consistently and widely than a metaphor. Also, a metaphor is a statement (even if implied), whereas a symbol need not be a statement. The common element in symbols and metaphors is that the literal, conventional meaning is exceeded or negated by a nonliteral meaning.

Symbols may have very narrow or quite wide ranges of meaning. The range may be limited to an individual, or perhaps to a small group. People other than the individual or group will not understand that meaning of the symbol. A symbol's range may be cultural, meaning that it is known by members of cultural groups: ethnic groups, religious groups, national groups, and so on.

Some people believe that some symbols have a universal range of meaning; that is, like C. G. Jung, they believe that some symbols occur with the same meaning across individual and cultural boundaries. These universal symbols are often called archetypes, especially by followers of Jung. While there is much evidence to support the existence of universal symbols, or archetypes, one must remember that any use of a symbol is specific, and that makes its meaning specific. Just as the word "tree" used in a sentence has a specific meaning, rather than the general meaning given in the dictionary, so an archetype used in a work of art has specific meanings, rather than a general meaning one might find in a dictionary of archetypes. (Such dictionaries exist).

Archetypes include more than symbols—they also include character types, basic plots (cf. the Monomyth), scenes, and so on. Essentially, archetypes are universally meaningful, nonliteral elements in the arts and culture.

The instant invention builds on the above principles by providing a means for easily and effectively communicating a specific story or a tale by way of a limited number of images or symbols. The invention also contemplates that an image on one of the plurality of buttons can be used as a control or cue image, for example differentiating between a riddle, question, statement and the like.

The invention builds on a recognition that the idea of passing on a message through an image has been practiced before. Egyptian hieroglyphs are the living example of conveying messages through series of images. The same rule applies to modern day images. It is a universal fact that a picture is worth thousand words. Each picture and/or image can effectively communicate if created with care and contemplation. An image is an iconic mental representation. Humans identify an image by referring to the stored simulations in their subconscious. In simple words, image is a combination of various design elements and/or entities that conjure up a series of signals in the memory that identifies common elements in the image and construct a mental comprehension that helps humans understand the message.

The main purpose of graphic design is to convey an important message through a picture or an image. Generally, text is also an image element that helps the viewers understand underlying message in the image. Similarly sketches, lines, dots and basic shapes combine to create an image that can help a viewer comprehend the image as a whole entity.

To effectively convey a message through an image, one has to understand the human mind and how it reacts on seeing an image since a graphic representation grabs the attention of the viewer instantly before he ever considers reading the accompanying text. Therefore, the graphic representation generally compliments the text providing an opportunity to understand the text accompanying it. In one form, the instant invention utilizes symbols or graphic elements only and disallows use of any text thus providing an effective way to create an image through a series of familiar graphic elements that logically flows in a harmonious manner creating a familiar picture in the mind of viewers or create an image through a series of familiar graphic elements that are disposed in a conventionally non-logical manner and/or non-related manner so as to facilitate a particular conversation and/or enact a particular action.

The invention claimed is:

1. A button assembly comprising:

a back member including a base portion having a first aperture formed through a thickness thereof, a peripheral wall and a first peripheral flange extending from a distal edge of said peripheral wall and tapering outwardly;

a socket or a stud having a surface thereof in a direct abutting engagement with an interior surface of said back member and a second aperture formed through a thickness of said socket or said stud in an alignment with said first aperture formed through said thickness of said base portion;

a fastener passed through said first and second apertures, said fastener caging thickness portions of said base portion and said socket or said stud adjacent said first and second apertures so as to secure said socket or said stud to said base portion; and a shell having a convex partially spherical shape with a second peripheral flange being tapered inwardly, wherein a peripheral edge of said second peripheral flange abuts an exterior surface of said first peripheral flange.

2. The button assembly of claim 1, further comprising an image disposed on an exterior surface of said shell.

3. The button assembly of claim 2, wherein said image is being directly adhered to an exterior surface of said shell.

4. The button assembly of claim 2, further including a clear protective member covering said image.

5. The button assembly of claim 2, wherein said image is only one of a symbol and a graphic element and excludes text.

6. The button assembly of claim 2, further comprising a substrate having an opposite one of said socket or said stud, whereby said button assembly is attachable to said substrate in a spaced apart relationship therewith.

7. a picture puzzle comprising:

a substrate;

a plurality of button assemblies, each of said plurality of buttons including:

a back member including a base portion having a first aperture formed through a thickness thereof, a peripheral wall and a first peripheral flange extending from a distal edge of said peripheral wall and tapering outwardly, a socket or a stud having a surface thereof in a direct abutting engagement with an interior surface of said back member and a second aperture formed through a thickness of said socket or said stud in an alignment with said first aperture formed through said thickness of said base portion, a fastener passed through said first and second apertures, said fastener caging abutting thickness portions of said base portion and said socket or said stud so as to secure said socket or said stud to said base portion, and a shell having a convex partially spherical shape with a second peripheral flange being tapered inwardly, wherein a peripheral edge of said second peripheral flange abuts an exterior surface of said first peripheral flange;

each of said plurality of button assemblies having a unique image disposed on an exterior surface of said shell; and a combination of said unique images, when positioned on said substrate, constructing said picture puzzle, wherein each unique image defines a portion of said picture puzzle.

8. The picture puzzle of claim 7, wherein said substrate is a pegboard having grid of apertures formed through a thickness thereof, each of said apertures receiving a respective socket or a stud.

9. The picture puzzle of claim 7, wherein said socket or said stud is offset from a center of said each button assembly.

10. The picture puzzle of claim 7, wherein said substrate has a 3-dimensional shape.

11. The picture puzzle of claim 10, further comprising an opposite one of said socket and said stud disposed on surface(s) of said substrate.

12. The picture puzzle of claim 10, wherein a combination of images of said plurality of button assemblies defines a model of an object.

13. A system for communication, discussion and/or expression of individual personality, comprising:

a substrate;

a plurality of button assemblies attached to said substrate, each of said plurality of buttons including:

a back member including a base portion having a first aperture formed through a thickness thereof, a peripheral wall and a first peripheral flange extending from a distal edge of said peripheral wall and tapering outwardly, a socket or a stud having a surface thereof in a direct abutting engagement with an interior surface of said back member and a second aperture formed through a thickness of said socket or said stud in an alignment with said first aperture formed through said thickness of said base portion, a fastener passed through said first and second apertures, said fastener caging abutting thickness portions of said base portion and said socket or said stud so as to secure said socket or said stud to said base portion, and a shell having a convex partially spherical shape with a second peripheral flange being tapered inwardly, wherein an interior surface of said second peripheral flange abuts a peripheral edge of said first peripheral flange; and each of said plurality of button assemblies having a unique image disposed on an exterior surface of said shell.

14. The system of claim 13, wherein a combination of said unique images, when attached to said substrate, initiates verbal conversation(s).

15. The system of claim 13, wherein a combination of said unique images, when attached to said substrate, defines a reward system or a badging program.

16. The system of claim 13, wherein a combination of said unique images corresponds with an online content or unlocks a specific online content.

17. The system of claim 13, wherein a combination of said unique images, when attached to said substrate, expresses moods, opinions, interests, or feelings.

18. The system of claim 13, wherein a combination of said unique images allows individuals to communicate a story, and/or tells their personal story, interests, or experiences.

19. The system of claim 13, wherein a combination of said unique images, when arranged on said substrate, defines a cipher.

* * * * *